US008033688B2

(12) United States Patent
Warton et al.

(10) Patent No.: US 8,033,688 B2
(45) Date of Patent: Oct. 11, 2011

(54) FIXTURE SUPPORT SYSTEM AND METHOD

(76) Inventors: Thomas Warton, Sonoma, CA (US); Scott S. Yu, Mill Valley, CA (US)

( * ) Notice: Subject to any disclaimer, the term of this patent is extended or adjusted under 35 U.S.C. 154(b) by 0 days.

(21) Appl. No.: 12/892,587

(22) Filed: Sep. 28, 2010

(65) Prior Publication Data

US 2011/0019396 A1 Jan. 27, 2011

Related U.S. Application Data

(62) Division of application No. 11/890,065, filed on Aug. 3, 2007.

(60) Provisional application No. 60/835,663, filed on Aug. 4, 2006.

(51) Int. Cl.
*F21V 21/14* (2006.01)
*F21V 19/02* (2006.01)

(52) U.S. Cl. ..... 362/269; 362/217.17; 362/260; 362/418; 362/429

(58) Field of Classification Search ..... 362/260, 362/432, 217.11, 217.12, 217.14, 217.15, 362/217.16, 217.17, 33, 269, 418, 427, 429
See application file for complete search history.

(56) References Cited

U.S. PATENT DOCUMENTS

| | | | | |
|---|---|---|---|---|
| 4,152,757 | A * | 5/1979 | Bilson et al. | 362/217.12 |
| 4,712,165 | A * | 12/1987 | Cetrone | 362/147 |
| 4,849,864 | A * | 7/1989 | Forrest | 362/225 |
| 6,168,292 | B1 * | 1/2001 | Sherman | 362/287 |
| 6,632,001 | B2 * | 10/2003 | Chen | 362/222 |
| 7,018,070 | B2 * | 3/2006 | McCoy | 362/260 |
| 7,484,979 | B2 | 2/2009 | Warton et al. | |
| 7,568,818 | B2 * | 8/2009 | Pfund | 362/303 |
| 7,604,209 | B2 | 10/2009 | Warton et al. | |
| 2008/0030982 | A1 | 2/2008 | Warton et al. | |

* cited by examiner

*Primary Examiner* — Jong-Suk (James) Lee
*Assistant Examiner* — Peggy A. Neils
(74) *Attorney, Agent, or Firm* — Antero & Tormey LLP; Peter Tormey

(57) ABSTRACT

A luminaire comprising a first hub comprising a first fixed portion rotatably coupled to a first rotor portion, said hub having an internal chamber, accessible through openings on the first fixed portion and the first rotor portion; a first lamp socket coupled to the first rotor portion of the first hub; a light rail affixed to the first rotor portion, said light rail having a bore the length of the light rail; a second hub comprising a second fixed portion rotatably coupled to a second rotor portion; and a second lamp socket coupled to the second rotor portion of the second hub, wherein a first set of one or more power wires is coupled to the first lamp socket, wherein a second set of power wires is disposed in the opening on the first fixed portion and further into the bore and is coupled to the second socket.

8 Claims, 9 Drawing Sheets

FIXTURE SUPPORT SYSTEM AND METHOD

This patent application is a divisional of U.S. application Ser. No. 11/890,065 file Aug. 3, 2007 by inventors Thomas Warton and Scott S. Yu which of claims the benefit of U.S. Provisional Patent Application No. 60/835,663 filed Aug. 4, 2006.

The present disclosure relates to lighting fixtures, and more particularly to a modular lighting system which comprises a plurality of lighting system components which can be presented in a plurality of housings.

BACKGROUND

Lighting fixtures are one of the basic lighting devices used in homes, offices and a variety of industrial settings. For example, a typical lighting fixture may be mounted on a wall, at a position above a desk, in a corridor, a door entrance, or a garage door such that the area can be illuminated by the lighting fixture. One criterion when selecting a lighting fixture is that the lighting is visually attractive. Another criterion is ease of installation. Additional criteria are performance, safety, legality and affordability. As lighting technologies improve, industrial lighting consumers require new and more aesthetic lighting designs to provided for the above listed criteria. All of these criteria are dynamic and change over time. As such there is a need for the modern, efficient lighting systems which can address these criteria in varying degrees.

SUMMARY

Disclosed herein is a luminaire system comprising a first hub comprising a first fixed portion rotatably coupled to a first rotor portion, said hub having an internal chamber, accessible through an opening on the first fixed portion and an opening on the first rotor portion; a first lamp socket coupled to the first rotor portion of the first hub for holding a lamp and providing electricity to the lamp; a light rail affixed to the first rotor portion, said light rail having at least one bore substantially the length of the light rail; a second hub comprising a second fixed portion rotatably coupled to a second rotor portion; and a second lamp socket coupled to the second rotor portion of the second hub, wherein a first set of one or more power wires is disposed in the opening on the first fixed portion and is coupled to the first lamp socket, wherein a second set of one or more power wires is disposed in the opening on the first fixed portion and further into the bore and is coupled to the second socket, such that the light rail is rotatable about the fixed portion of the first hub.

The construction and method of operation of the invention, however, together with additional objectives and advantages thereof will be best understood from the following description of specific embodiments when read in connection with the accompanying drawings.

DESCRIPTION

Figure 1:
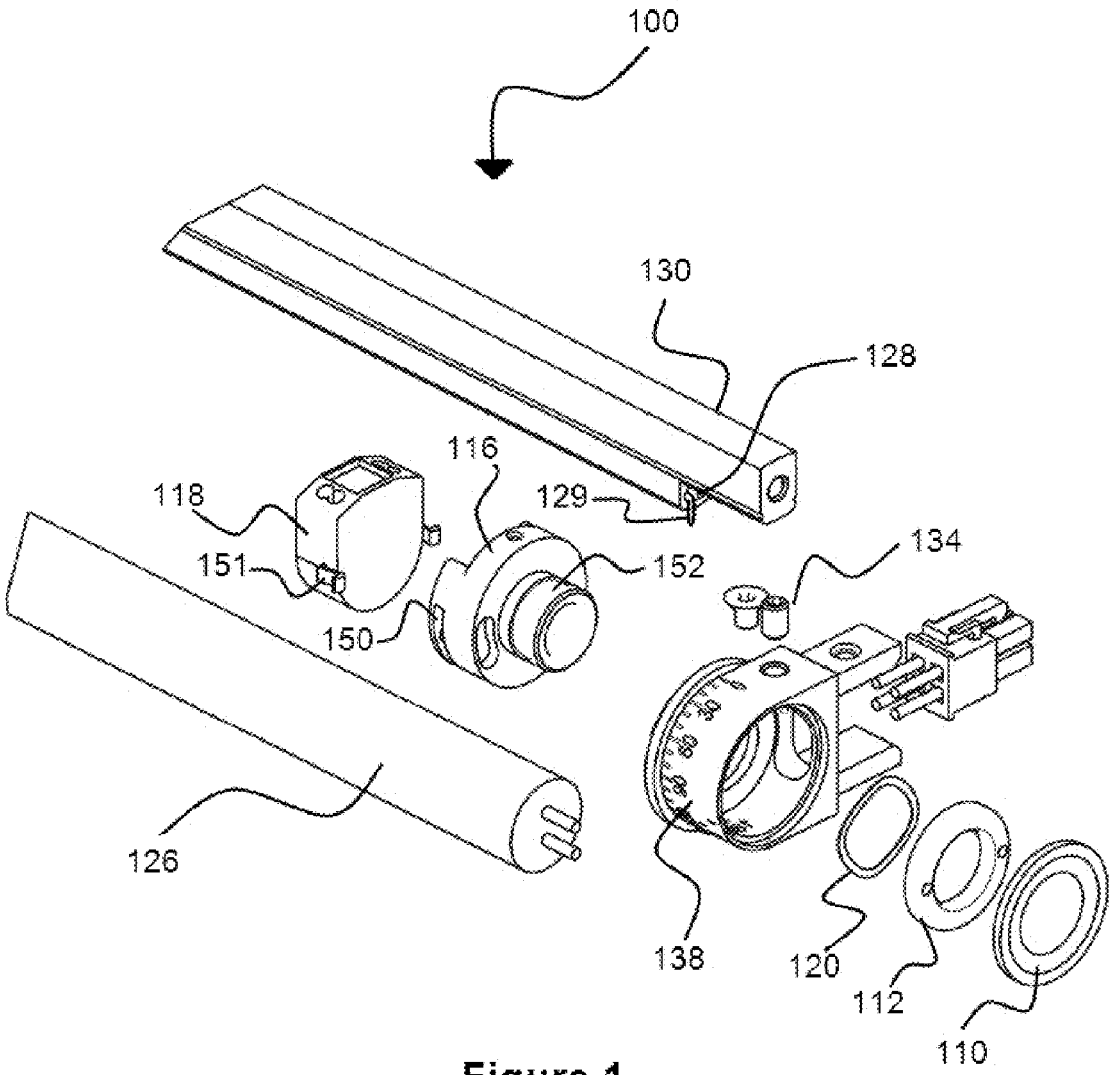
FIG. 1 shows one embodiment of a rotatable hub for a luminaire according to one aspect of the current disclosure

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 shows one embodiment of a rotatable hub 100 for a luminaire according to one aspect of the current disclosure. In this embodiment light rail 130 is shown such that electrical wiring can be run down a bore 128 of the rail frame 130. This access 128 is used to provide electricity to the opposite end of the lamp 126 through wire 129, without exposing the wire 129 to the heat of the lamp while still maintaining an attractive luminaire. In the figure the rail frame 130 has a rotatable hub on each end. The rotatable hub 100 comprises an electrical socket 118 (such as a BJB socket #26.641.2001 or similar) for holding the lamp 126 and providing electricity to operate the lamp, a socket base 116 for holding the socket 118. In this embodiment the socket base 116 has a raised threaded portion 152 which extends into an electrical connector housing 138. Mounting the socket base 116 on the threaded raised portion 152 allows the socket to swivel or rotate in relation to the electrical connector housing 138. The electrical connector housing 138 is mounted to the socket base 116 by a spring washer 120, a hub nut 112 and a hub cap 110. Since the hub nut 112 is screwed on to the threaded portion 152, the electrical connector housing 138 is rotatably coupled to the socket base 116. The electrical connector housing 138 has indicia on it indicating the relative position of the light rail 130. Set screw 134 holds the rotatable hub 100 in place once its position is set.

In view of the foregoing, one aspect of this embodiment is that socket base 116 has mounting holes 150 (only one shown) such that the tabs 151 of lamp socket 118 can mount by snapping in place. The size of mounting holes 150 is determined by the size of the tabs 151 on the socket 118. One having skill in the art would recognize that the design of socket base 116 can be modified to accommodate differing sockets 118 and still be within the spirit of the current invention. Thus socket holder 116 provides a means for passing electricity to one end of the lamp 126, providing structural support for the socket 118 and for holding the position of the light rail when set screw 134 is tightened.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
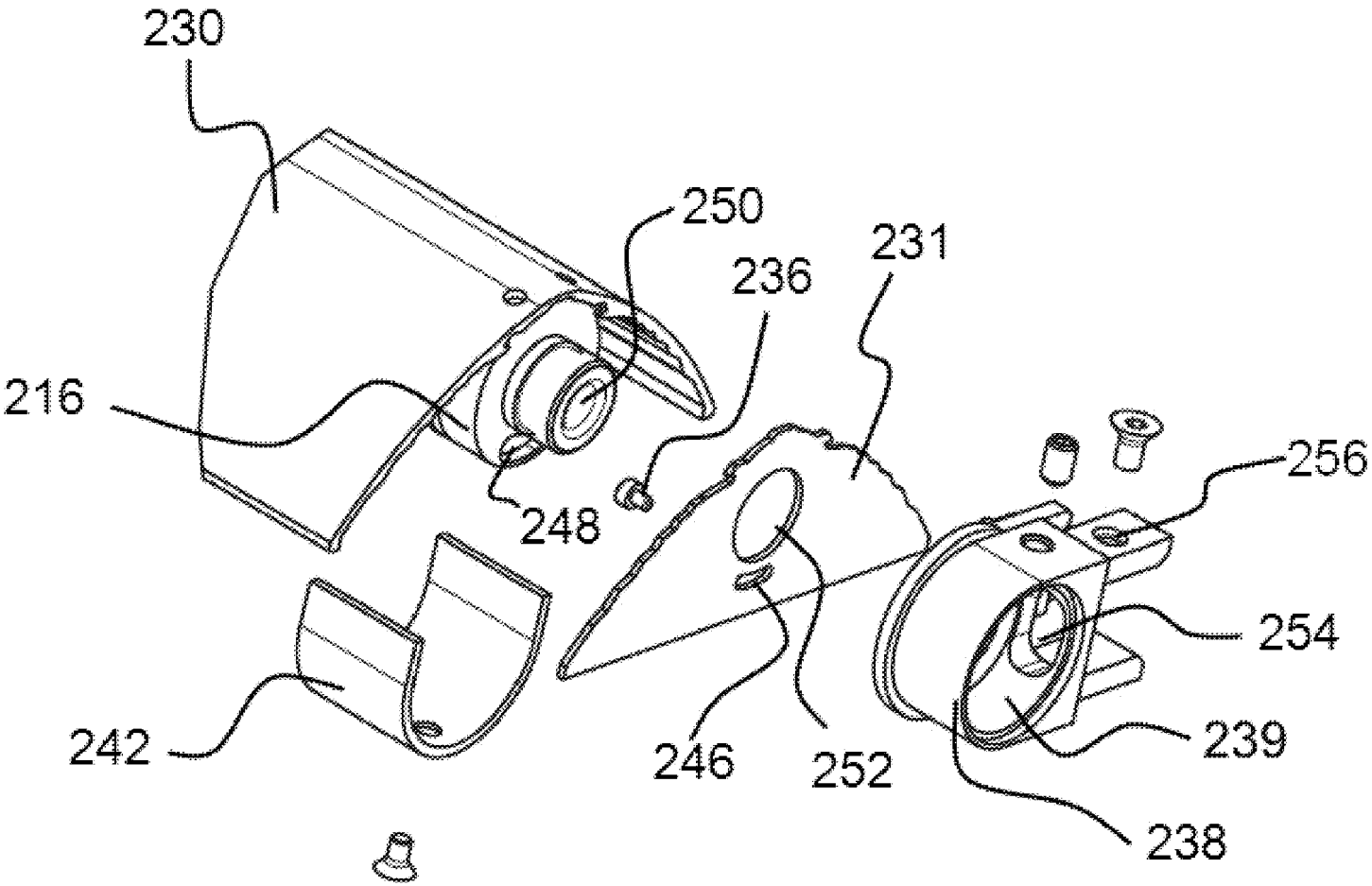
FIG. 2 shows attachment of a light rail to a rotatable hub.

FIG. 2 shows attachment of a light rail to a rotatable hub. In the figure a rotatable hub assembly is partially shown in an exploded diagram. The housing 238 is connected to a socket holder 216 by mounting hardware (not shown). The mounting hardware is screwed on to the socket holder 216 to provide support and to allow the socket holder 216 to rotate with respect to the housing 238. The rotation is limited by a stop pin 236. The stop pin has a first end disposed in slot 248 to allow a predetermined amount of play such that the stop pin is slidable. The stop pin has a second end that extends through the light rail portion 246 and into a hole (not shown) on the housing 238.

A light rail 230 is attached to the socket base 216 such that the light rail rotates with the socket base 216. A portion of the light rail 231 is affixed to the socket base 216 and has an elongated hole 246 for the stop pin 236 to pass through and a second hole 252 for the threaded portion of the socket base 216 to pass through. The socket holder 216 has a bore 250 through it to allow for passage of electrical wiring to control the lamp (not shown). The wires would extend from the socket, through the bore 250 in the socket base 216 and into the cavity 239 in the center of the housing 238. The wires would extend further outside the housing 236 through hole 254 and exit the housing. In the example shown the light rail has an escutcheon 242 to cover the socket (not shown) and socket holder 216.

The hole 254 may have elongated members (or prongs) 256 on one or more sides for use in supporting the device. The elongated members may be formed with threaded holes for receiving a fastener or with other means for attaching the elongated members to a supporting structure.

In operation the rotatable hub rotates until a stop (not shown) on the housing 238 contacts the stop pin 236. The stop pin, by having some play allows for rotation in excess of 360 degrees. The amount of allowable rotation determined by the length of slot 248. The stop pin provides protection from rotating the rotatable hub to a point where the wiring would bunch and experience stress to the point of damaging the luminaire. In this illustration the light rail 230 can be easily changed with light rails of differing shapes. Also the design of the housing 238 provides for easy mounting to a support arm (not shown) to fix a luminaire to a ceiling, wall or other support structure.

Figure 3:
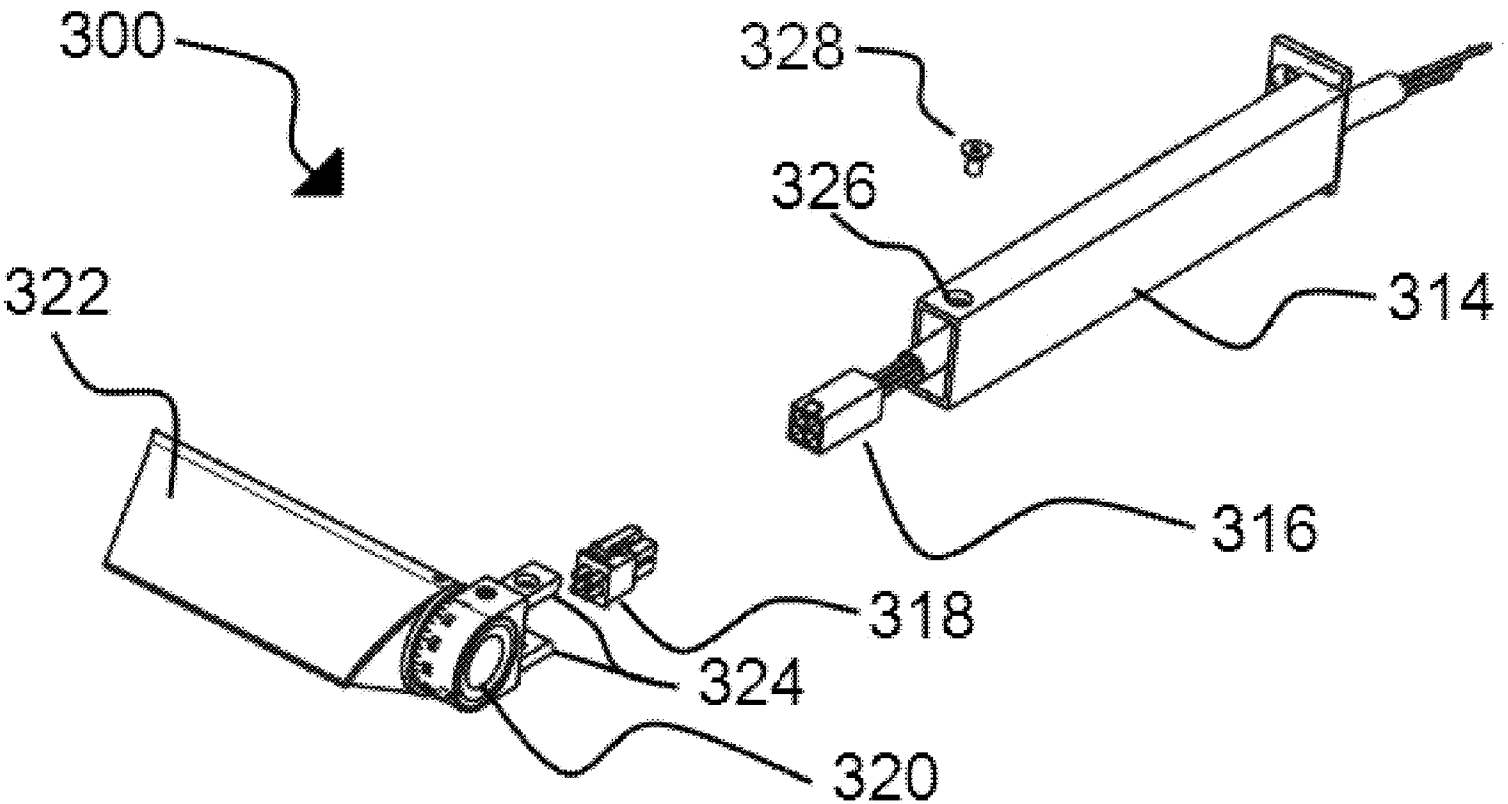
FIG. 3 illustrates one way to mount the luminaire to a structural support.

FIG. 3 illustrates one way to mount the luminaire to a structural support. A rotatable hub 320 is attached to a light rail 322. The rotatable hub 320 has two extended members or prongs 324 disposed to fit into the inner cavity or passage of a hollow support arm 314. Each of the extended members has a threaded female screw hole and the hollow support arm 314 has at least one hole 326 for alignment to the threaded female screw holes. The electrical wiring for providing power to a lamp (not shown) is disposed into the hollow of support arm 314 and terminates at a connector 316. A matching connector 318 is attached to wires (not shown) on the housing, which in turn are coupled to a lamp by way of a socket described above. The connector allows for quick disconnect of the entire fixture without having to remove the support arm 314 from the support structure.

In FIG. 3 the extended members 324 are designed to fit snugly into the hollow of support arm 314 and the housing of the rotatable hub 320 is designed to be substantially the same as the support arm 314. Thus when the rotatable hub 320 is placed into the support arm 314 the hub aligns such that the light rail is perpendicular to the support arm 314. This allows for easy installation of the luminaire. The support arm 314 may have an opening 326 for receiving a set screw, bolt or other fastener 328. The fastener 328 may be formed to coupled with a threaded hole on extended members 324.

Figure 4:
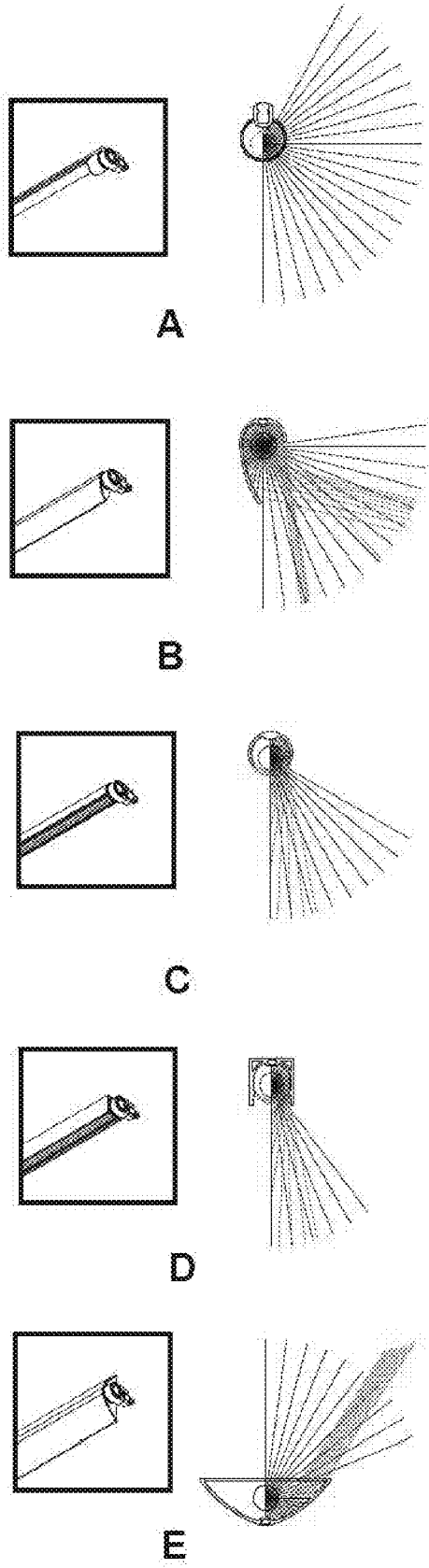
FIG. 4 illustrates several examples of light rails used in accordance with the current disclosure and their corresponding light direction patterns.

FIG. 4 illustrates several examples of light rails used in accordance with the current disclosure and their corresponding light direction patterns. One feature of the current invention is the ability to change light rails to light rail A is a Bee rail, light rail B is a Wing rail, light rail C is a race rail, light rail D is a box rail and light rail E is a Que rail. The light rails may be made from aluminum or other materials strong enough to support the weight and temperature requirements for the luminaire.

Figure 5:
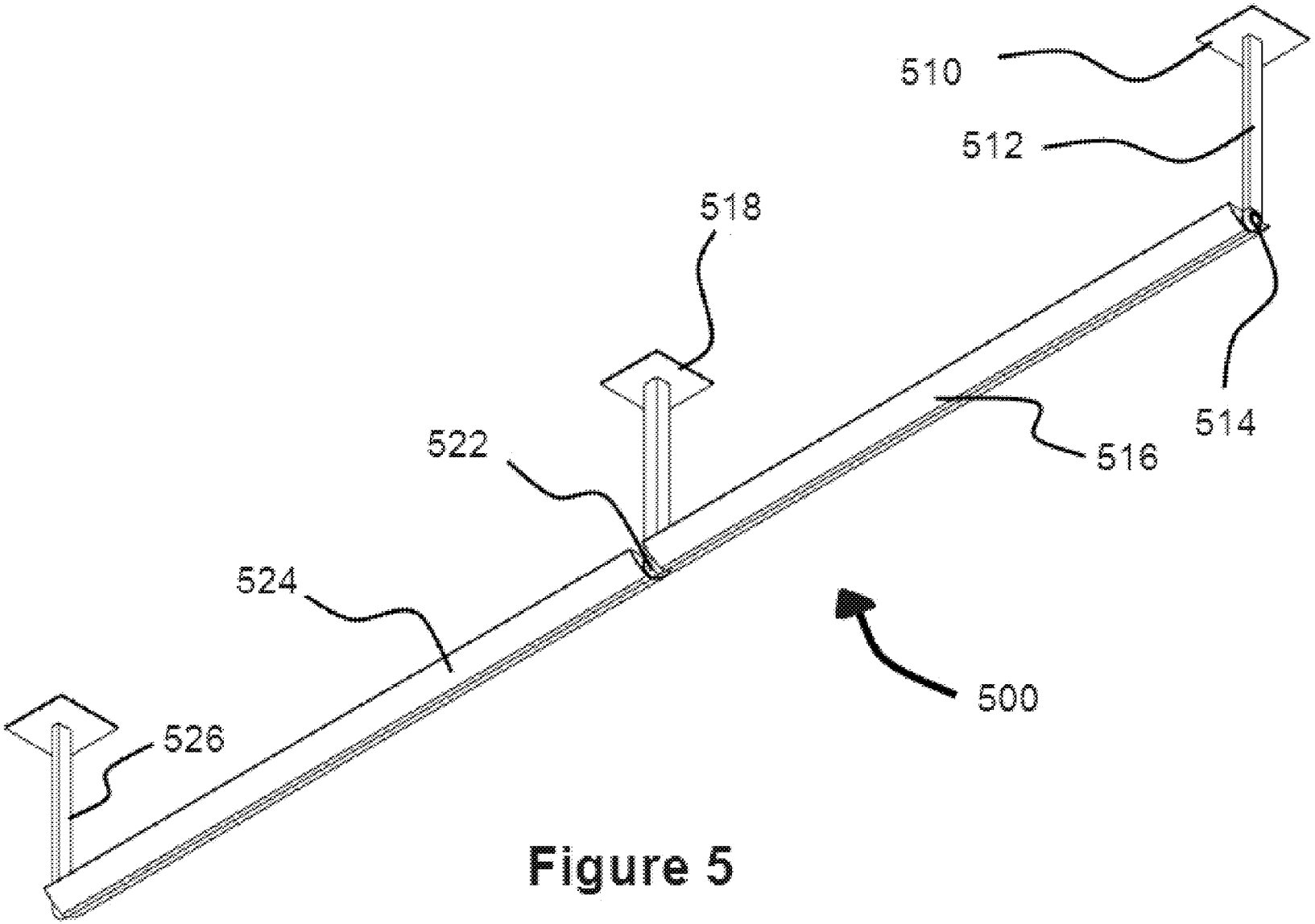
FIG. 5 shows an embodiment of a luminaire having multiple segments.

FIG. 5 shows an embodiment of a luminaire having multiple segments 500. A mounting structure 510 supports an arm 512. At the end of the arm is a hub 514. Electrical wires are run through the support arm to the hub assembly 514 and through the hub assembly 514 to the lamp. A light rail 516 is connected to the hub assembly 514 at one end and at the other end of the light rail 516 is another hub assembly 522 connected to a second support arm 522 and to a mounting structure 518. Different light rails can be used and multiple light rails can be connected together. In this figure, electrical wiring is run internally to the light rail, such that only one hub need be electrically powered for each lamp. In the disclosure shown, electrical wires would be run internally to arm 512 to hub 514 to power the lamp in light rail 516. Electrical wiring would also be run internal to arm 520 to hub 522 for powering light rail 524. In the embodiment shown arm 526 does not require any electrical wiring. By eliminating the need to run wires in all three arms, this embodiment provides for a light fixture that is easier to install than conventional light fixtures.

Figure 6:
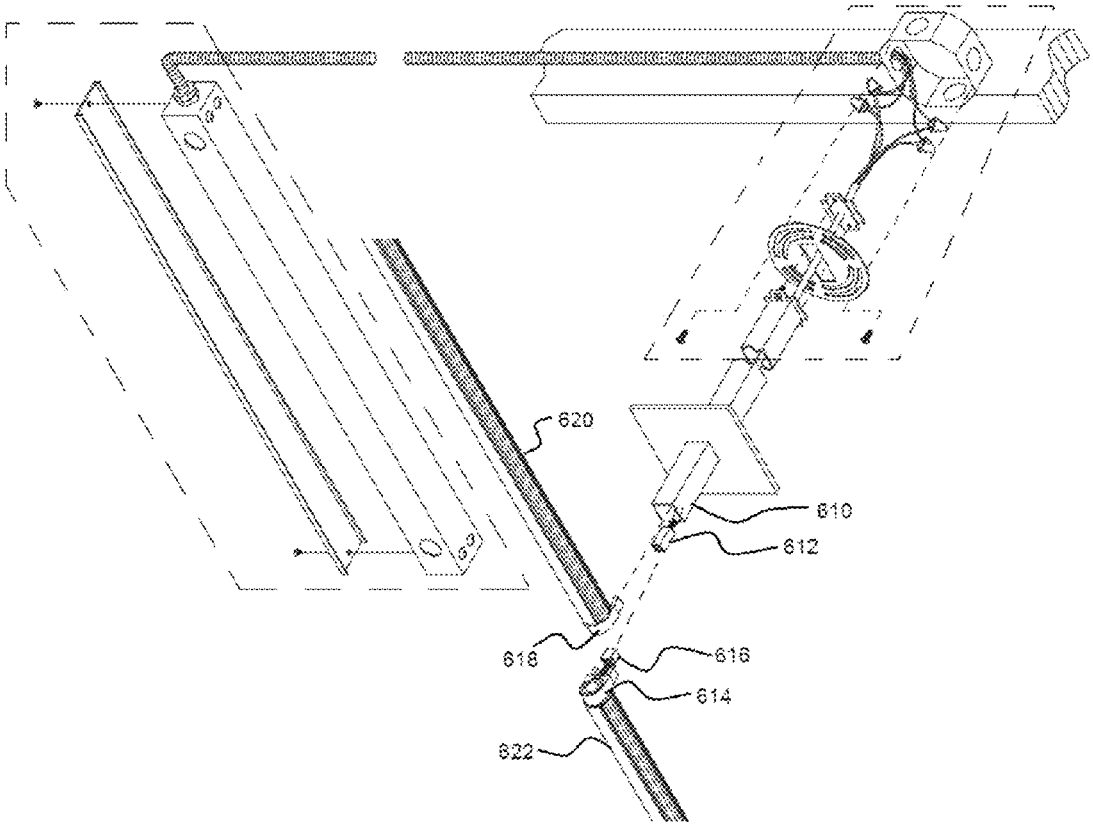
FIG. 6 shows details of how one to install one embodiment according to the current disclosure.

FIG. 6 shows details of how one to install one embodiment according to the current disclosure. In this detail, electrical wiring is run internally to arm 610 to connector 612. Connector 612 connects to connector 616 located on the hub 614. Because one embodiment of the current invention may provide for electrical wiring internal to the light rail, hub 618 may not need electrical wiring. FIG. 6 also shows the installation of two light rails (620 and 622) into arm 610. The hub 614 is designed to fit squarely into the arms such that when two hubs are inserted into an arm, they provide for easier alignment. Similar ease of alignment can be realized using multiple shaped hubs and arms, such that additional light rails other than those shown can be constructed or different angles between the light rails may be built. For example, a designer may want 4 light rails installed in a single arm or a 90 degree angle between two of the light rails.

Figure 7:
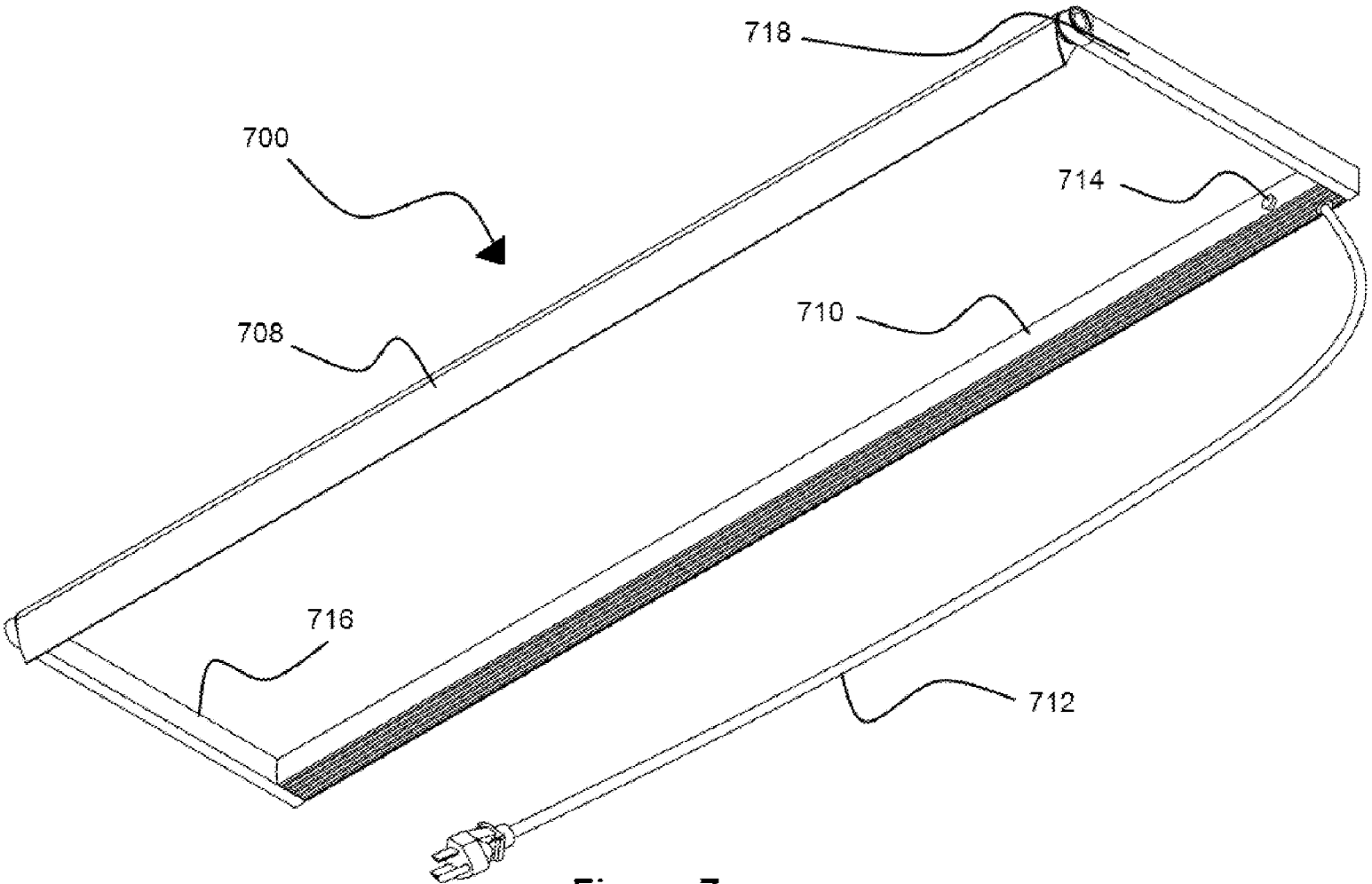
FIG. 7 shows one aspect for providing a luminaire over a workspace such as a desk.

FIG. 7 shows one aspect for providing a luminaire over a workspace such as a desk 700. In the figure a single light rail 708 is connected to two support arms 716 and 718. The support arms are connected to a main chassis 710 which may include ballast for the lamp. Also main chassis 710 may be used to facilitate mounting the lighting system above a desk or other structure. This embodiment would typically mount under an overhead storage cabinet or bookshelf located above a desk. Power is supplied to the lamp through electrical connector 712 and On/Off switch 714.

Figure 8:
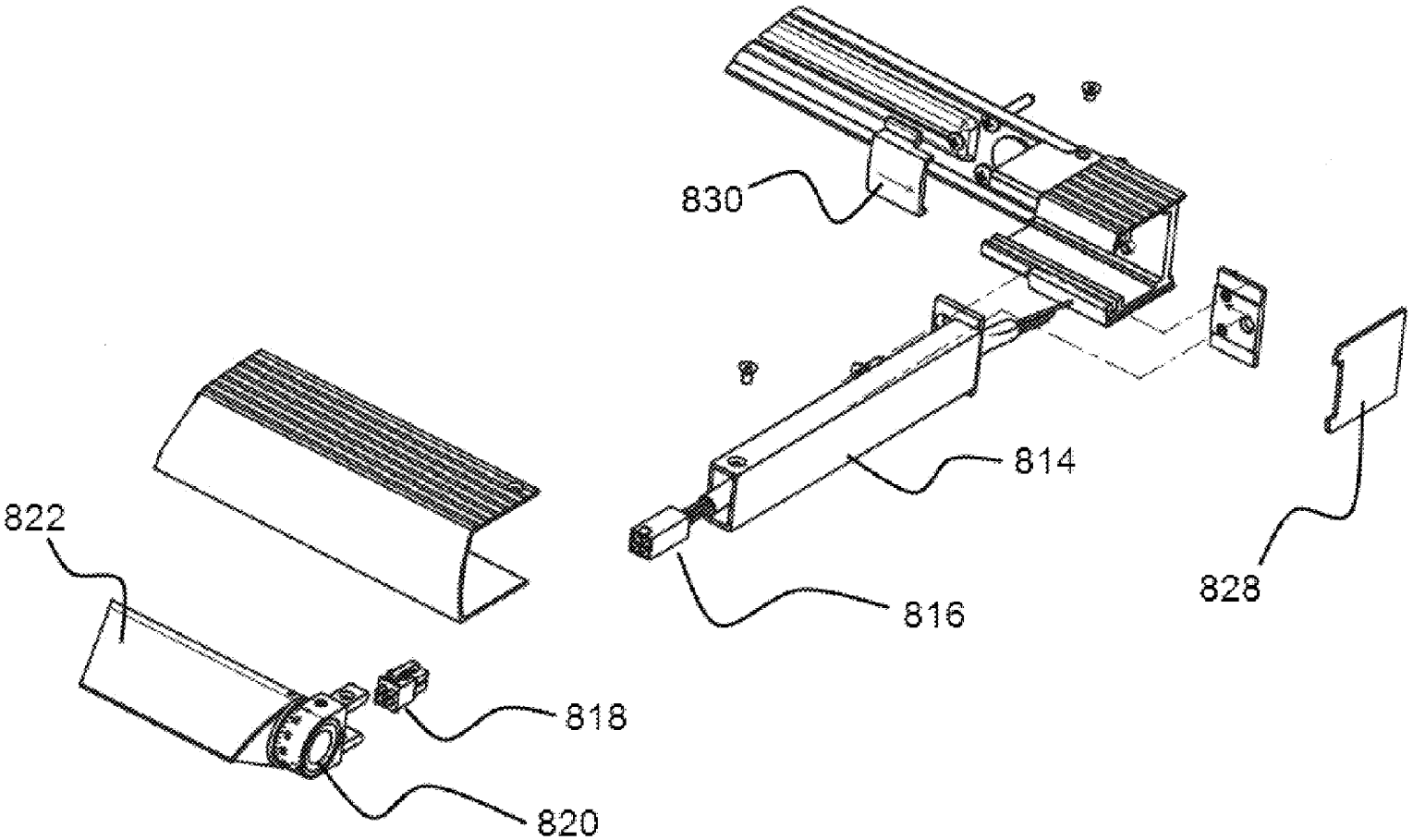
FIG. 8 shows an exploded view of portions of a luminaire for over a workspace.

FIG. 8 shows the details of a portion of the example shown in FIG. 7. In FIG. 8 the luminaire is shown as a light rail 822 connected to a hub 820. Electricity is supplied to the lamp (not shown) through wires (not shown) connected to electrical connector 818. Electrical connector 818 connects to electrical connector 816 which is connected to wires through the core of arm 814. Electricity is supplied from ballasting equipment not shown. Items 828 and 830 are escutcheons for providing an aesthetic appeal. This figure illustrates one of the features of the disclosure for providing a modular system wherein many different luminaires may be formed to meet differing needs, while using common parts and assembly. This provides for more affordable manufacturing and ease of installation.

Figure 9:
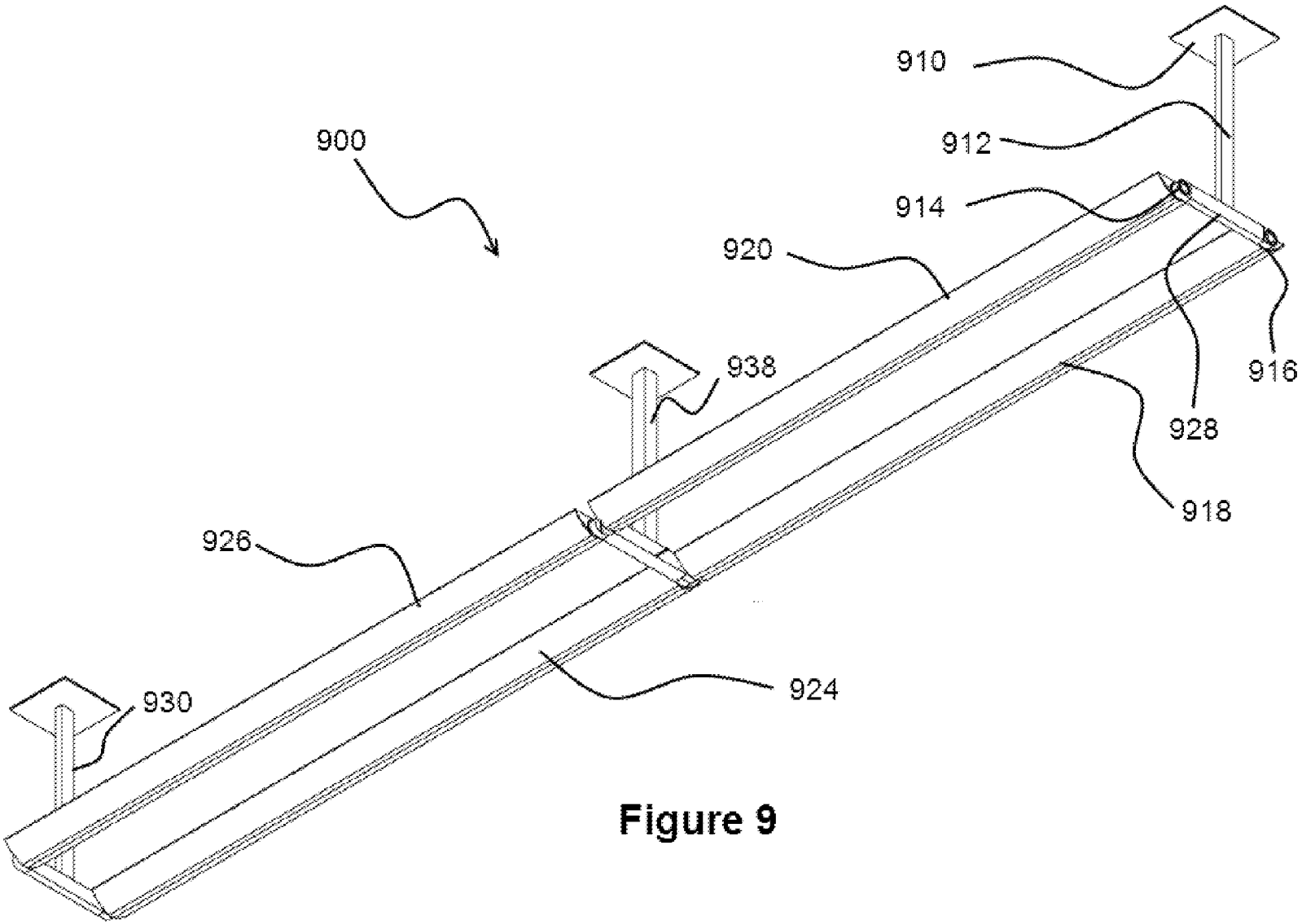
FIG. 9 shows a double light rail system according to the current disclosure.

FIG. 9 shows a double light rail system 900 according to the current disclosure. In this figure a mounting structure 910 connects to a support arm 912 and supports a hub connector 928. The hub connector 928 supports the first hub 914 and a second hub assembly 916. Each hub supports one or more light rails 920, 918, 926, and 924. The electrical connections for the lamps may run internally through the support arms 912 and may also run internally to the light rails 920, such that only a single support arm has electrical wiring in it. Typically in the double light rail system 900, electrical wires would be run through arm 912 and arm 928 obviating the need for wiring in arm 930. In this disclosure two variations of the hub are used, a "right-hand" hub and a "left-hand" hub. The primary difference between the right-hand hub and the left-hand hub is the existence of electrical connections for lamps and mounting hardware, although other structural differences may also be employed. This disclosure allows multiple light rails to be strung together. Multiple support arms, hub assemblies and light rails allow for different configurations of lights being grouped together. One having skill and the art would appreciate that the current invention can be mounted from a variety of structural supports such as a ceiling with a light rail directing the light up or down, or from a wall with a light rail directing the light out, down, up or back across the wall to provide for reflective or indirect lighting. Multiple light rails positioned to illuminate in different directions can be used.

One aspect of the current disclosure is that electricity is only supplied to one hub for each lamp. Each light rail described above has a bore running substantially the length of the light rail to allow for electrical wires to extend through the bore and couple to the socket at the other end. This facilitates ease of installation and reduces costs because power only needs to be supplied to a single arm in many situations.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device comprising:

a housing having an opening providing access to a central cavity, said housing including a fixed portion and a rotatable portion;

a first elongated member disposed in the fixed portion along the edge of the opening, having a tapered end extending away from the central cavity;

a lamp socket coupled to the rotatable portion, said lamp socket disposed for receiving a lamp opposite to the central cavity;

a second elongated member, substantially similar to the first elongated member, disposed on the other side of the opening from the first elongated member and extending away from the central cavity with the effect that the opening is bordered on two sides by the elongated members, and a hollow arm disposed over the elongated member, said hollow having an interior dimension substantially equal to a width of the elongated member;

with the effect that the lamp socket substantially aligns perpendicular to the arm.

2. The device of claim 1 wherein the elongated members each have a threaded receiver.

3. The device of claim 2 wherein the hollow arms each have a hole that substantially aligns with the receiver.

4. The device of claim 1 further including a wire disposed in the hollow of the arm, said wire having a connector at one end.

5. The device of claim 1 further including:

a light rail connected to the housing.

6. The device of claim 5 wherein the light rail is formed to reflect light, said light provided by a lamp disposed in the lamp socket.

7. The device of claim 1 further comprising:

a light rail coupled to the rotatable portion such that the light rail is substantially perpendicular to the arm.

8. The device of claim 7 wherein the rail is formed to reflect light, said light from a lamp disposed in the socket.

* * * * *